US006348673B2

(12) United States Patent
Winters

(10) Patent No.: US 6,348,673 B2
(45) Date of Patent: Feb. 19, 2002

(54) DEVICE TO MELT ICE AND SNOW IN A ROOF VALLEY

(76) Inventor: Michael A. Winters, 706 S. Black Ave., Bozeman, MT (US) 59715

( * ) Notice: Subject to any disclaimer, the term of this patent is extended or adjusted under 35 U.S.C. 154(b) by 0 days.

(21) Appl. No.: 09/777,169

(22) Filed: Feb. 5, 2001

Related U.S. Application Data

(60) Provisional application No. 60/179,994, filed on Feb. 3, 2000.

(51) Int. Cl.[7] ..... H05B 1/00
(52) U.S. Cl. ..... 219/213
(58) Field of Search ..... 219/213, 214, 219/528, 544, 546, 547, 548, 552, 553; 392/435, 436

(56) References Cited

U.S. PATENT DOCUMENTS

| | | | | | |
|---|---|---|---|---|---|
| 2,507,039 | A | * | 5/1950 | Miller | 219/213 |
| 3,141,955 | A | | 7/1964 | Culpepper | |
| 3,521,029 | A | * | 7/1970 | Toyooka et al. | 219/213 |
| 3,617,691 | A | * | 11/1971 | Toyooka | 219/201 |
| 3,725,683 | A | * | 4/1973 | Solin et al. | 219/213 |
| 3,784,783 | A | | 1/1974 | Gray | |
| 4,081,657 | A | | 3/1978 | Stanford | |
| 4,401,880 | A | | 8/1983 | Eizenhoefer | |
| 4,769,526 | A | | 9/1988 | Taouil | |
| 5,391,858 | A | | 2/1995 | Tourangeau et al. | |
| 5,786,563 | A | | 7/1998 | Tiburzi | |
| 6,087,630 | A | | 7/2000 | Miller et al. | |

* cited by examiner

*Primary Examiner*—Sang Paik
(74) *Attorney, Agent, or Firm*—Richard C. Conover

(57) ABSTRACT

A heated roof valley device for melting ice and snow accumulating on a roof valley including a generally "V"-shaped lower casing and a corresponding "V"-shaped cover positioned in spaced-apart relation to the lower casing. An electrical heating element positioned in the space between the lower casing and the cover, and a moisture sealing device for preventing moisture in the roof valley from entering the space between the lower casing and the cover.

4 Claims, 3 Drawing Sheets

DEVICE TO MELT ICE AND SNOW IN A ROOF VALLEY

This application claims benefit of Provisional No. 60/179,994 filed Feb. 3, 2000.

BACKGROUND OF INVENTION

The present invention relates to a heated roof valley device for melting snow and ice forming in a roof valley.

It is known that snow and ice forming in roof valleys during the winter presents serious problems. When snow or ice accumulates in the roof valley, the valley will not properly drain. This blockage causes further snow and ice to accumulate further up the valley. A large accumulation of ice and snow may present weight problems for the particular roof. Further, the accumulation of moisture on the roof may lead to roof leakage problems. In addition, when the snow and ice begins to melt in the roof valley, the accumulation can come down all at once presenting dangers for persons standing below the ice valley.

Roof de-icing devices are well known. For example, see U.S. Pat. No. 4,769,526 to Taouil and U.S. Pat. No. 5,391,858 to Tourangeau, et al. In general, these prior art devices are located at the drip edge adjacent the roof gutters. Another patent, U.S. Pat. No. 5,930,457 to Tourangeau describes a heat cell for a roof which, when used in pairs, can be used to prevent ice and snow from forming in a roof valley.

SUMMARY OF INVENTION

The present invention relates to a roof valley heating device which has a "V" configuration and which can be easily installed in a roof valley adjacent the drip edge portion of the valley. A conventional metal valley is positioned to partially overlay the present invention so that moisture from the conventional roof valley drains onto the present invention. The present invention solves the problem of accumulation of snow and ice in roof valleys, and is a one-piece unit which can be easily installed when the roof valley is being constructed.

DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
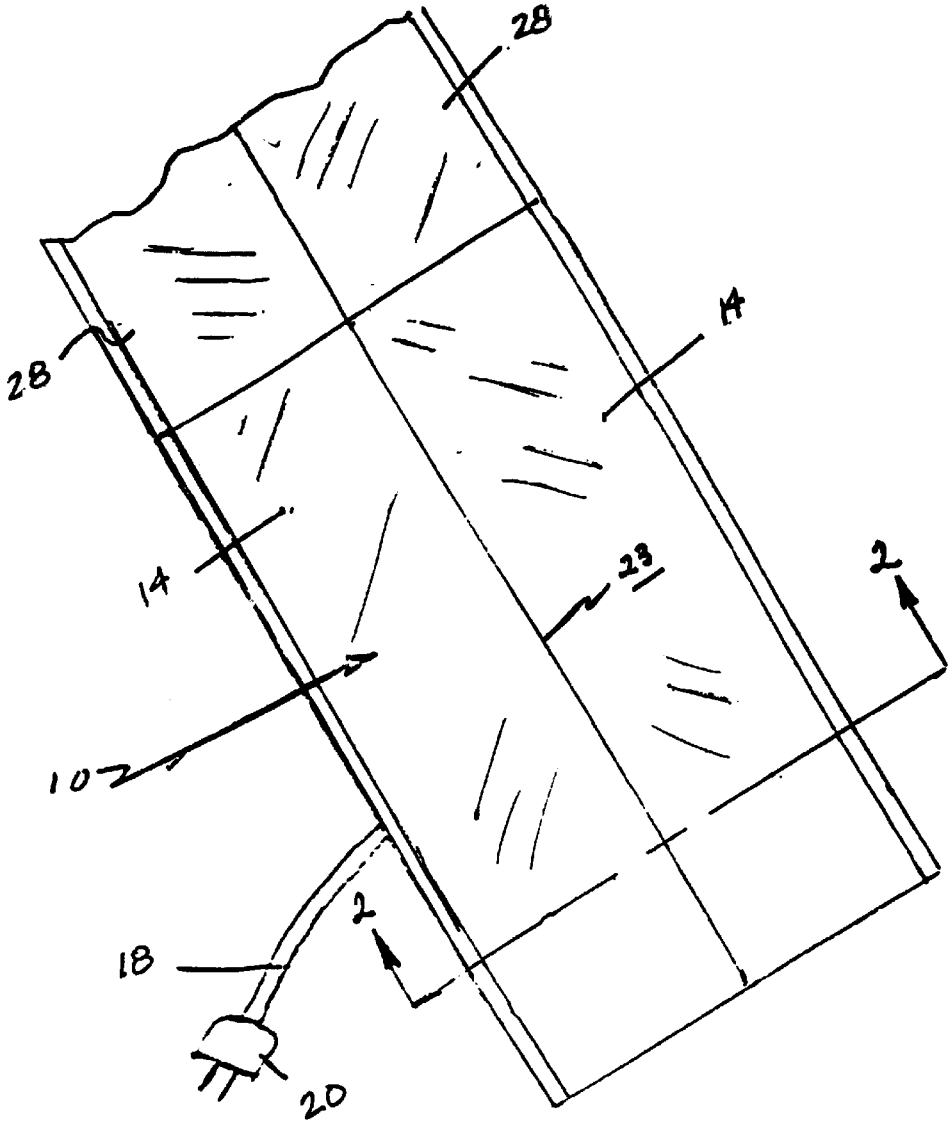
FIG. 1 is a respective view of the present invention.
Figure 2:
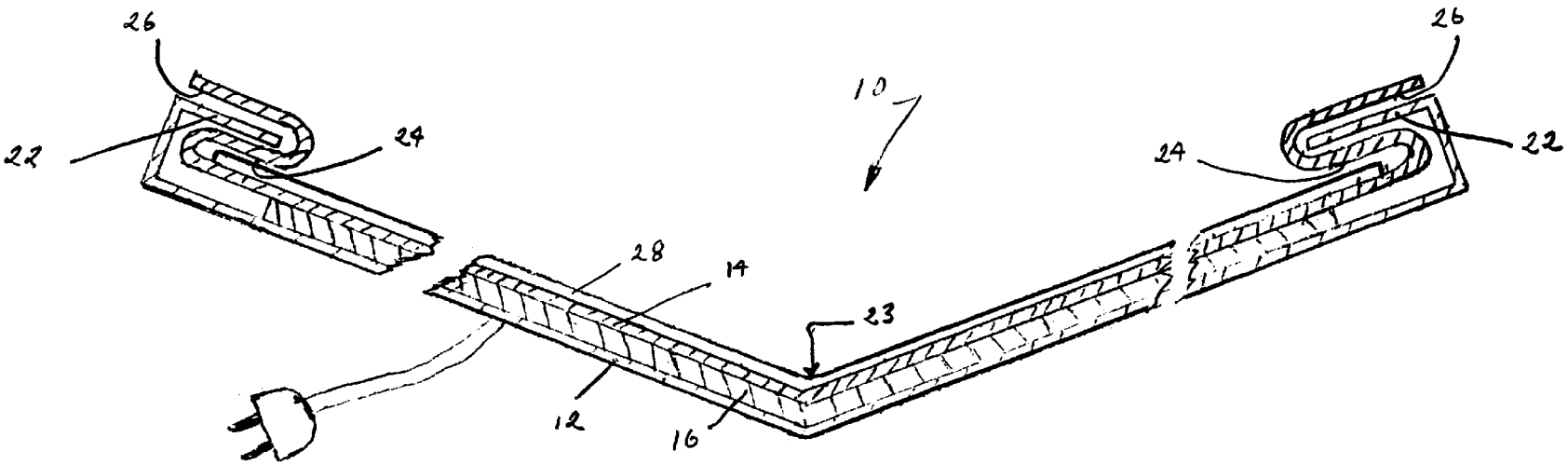
FIG. 2 is a cross-sectional view along line 2—2 in FIG. 1.

A heated roof valley device 10 according to the present invention is shown in FIGS. 1 and 2. The heated roof valley device 10 includes a generally "V"-shaped lower casing 12 and a corresponding "V"-shaped cover 14 positioned in spaced-apart relation to the lower casing 12. A fiber mesh heat mat 16 is positioned within the space between lower casing 12 and upper cover 14, as shown in FIG. 2, with the heat mat extending substantially across the entire width of the device. In a preferred embodiment, this fiber mesh mat 20 is an EASY HEAT Series G Fiber Mesh Heat Mat manufactured by Easy Heat of New Carlyle, Ind. It should be understood that other heating elements could be used equally as well. The heated mat 16 is powered through an electrical cord 18 which has a male plug 20 for insertion into a conventional electrical outlet located in the roof of a building.

The lower casing 12, at each lateral edge thereof, includes a squared "U" terminal portion bending back on itself with a leg 22 extending toward a valley centerline 23 as shown in FIG. 2. Each lateral edge of the valley cover 14 is shaped to have an "S" configuration with a lower opening 24 extending in a direction toward the centerline 23 and an upper opening 26 extending away from the centerline 23.

The leg 22 of the lower casing 12 is positioned to extend into the upper opening 26 of the cover 14. When the present invention 10 is installed in a roof valley, it is positioned at the terminal drip edge end of the valley. A conventional valley drain member 28 is positioned to partially cover the invention 10 as shown in FIG. 1 so that moisture on the drain member 28 will drain onto the heated valley 10. The lateral edges of the valley drain member 28 are positioned within the lower opening 24 of the cover 14 as shown in FIG. 2.

In a preferred embodiment, the heated valley device 10 is approximately 24-inches wide. The heat mat 16 extends approximately full width on either side of the valley. The heat mat is constructed to provide a temperature between 80°–100° F., and it is powered with a 240 volt line. The heated valley device 10 extends from the lowest end of the valley mounted on a roof up the roof approximately 10 feet.

Figure 3:
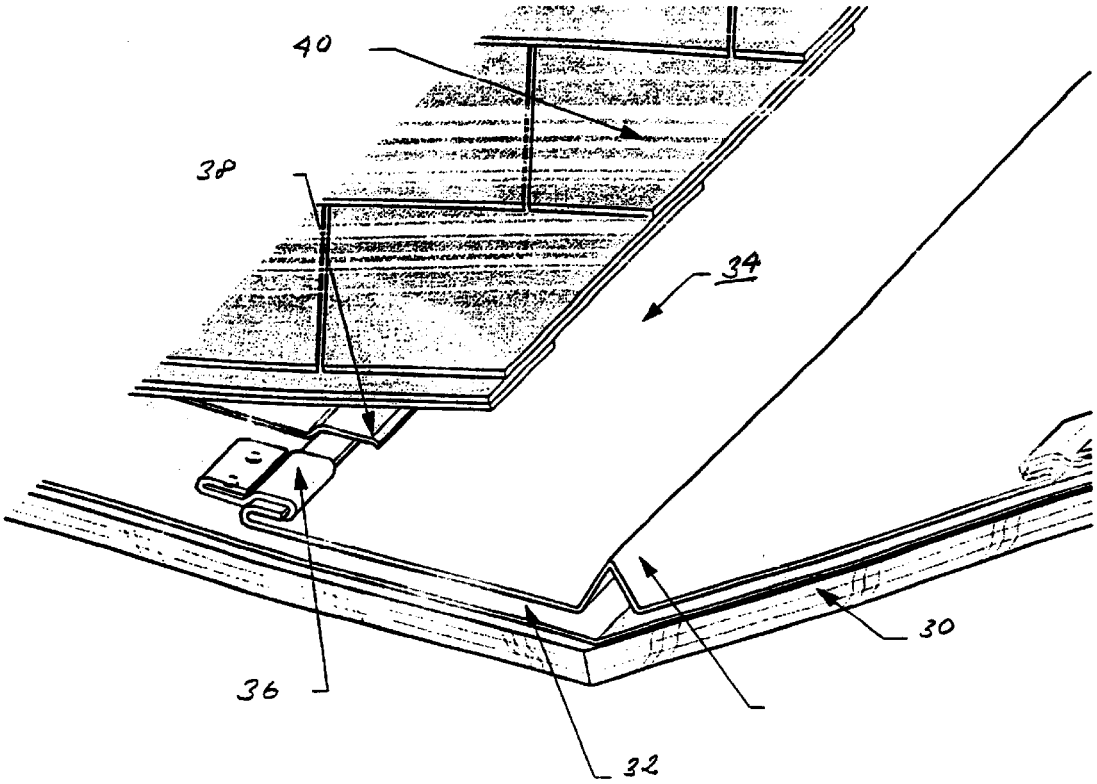
FIG. 3 is a partial cross-sectional view through a conventional metal valley.

In practice, the heated valley device 10, according to the present invention, is constructed as a unit. It is installed in the same manner as a conventional roof valley which is shown in cross-section in FIG. 3. In FIG. 3, a conventional roof includes a roof sheathing 30 over which is installed an underlayment 32. A conventional roof valley 34 is shown installed. When using the present invention, the heated roof valley device 10 is installed in the same manner as conventional roof valley 34 with clips 36, as shown in FIG. 3. The clips 36 are nailed or screwed into the roof sheathing 30 in a conventional manner. When using the present invention, the clip 36 has a portion which fits over the lateral edges of the heated valley device 10 as shown in FIG. 2. Again, with reference to FIG. 3, a felt underlayment 38 is installed over the lateral edges of the conventional roof valley 28, or when using the present invention, over the lateral edges of the heated valley device 10. Valley shingles 40 are then installed over the lateral edges of the roof valley as shown in FIG. 3.

When the heated valley device 10 is installed in the manner as shown in FIG. 3, the plug 20 is then connected to an electrical outlet in a conventional manner so that heated mat 16 is powered and provides heat to the cover 14. In this way, ice is prevented from forming on the lower end of the valley.

While the fundamental novel features of the invention have been shown and described, it should be understood that various substitutions, modifications, and variations may be made by those skilled in the art, without departing from the spirit or scope of the invention. Accordingly, all such modifications or variations are included in the scope of the invention as defined by the following claims.

I claim:

1. A heated roof valley device for melting ice and snow accumulating on a generally "V"-shaped roof valley comprising:

a generally open top "V"-shaped lower casing means for nesting in the roof valley;

a corresponding open top "V"-shaped cover positioned in spaced-apart relation to the lower casing;

an electrical heating element positioned in the space between the lower casing and the cover; and a moisture sealing device for preventing moisture in the roof valley from entering the space between the lower casing and the cover.

2. A heated roof valley device for melting ice and snow accumulating on a generally "V"-shaped roof valley with a centerline, the roof valley provided with a valley drain member having lateral edges comprising:

a generally "V"-shaped lower casing and a corresponding "V"-shaped cover positioned in spaced-apart relation to the lower casing;

an electrical heating element positioned in the space between the lower casing and the cover;

the lower casing at each lateral edge thereof having a squared "U" terminal portion bending back on itself with a leg extending toward the centerline of the "V"-shaped roof valley and wherein each lateral edge of the valley cover is shaped to have an upright "S" configuration with a lower opening extending toward the centerline of the roof valley and an upper opening extending away from the centerline of the roof valley;

wherein the inwardly extending leg of the lower casing extends into the upper opening of the "S"-shaped edge of the cover;

wherein the lower opening of the "S"-shaped edge of the cover is sized to receive the lateral edges of the valley drain member; and an electrical conduit means for directing electrical energy to the electrical heating mat.

3. The device according to claim 2 wherein the electrical heating element includes a heating mat extending substantially across the entire width of the device.

4. The device according to claim 2 wherein the lower casing and cover are constructed of metal.

* * * * *